United States Patent [19]

Bunger et al.

[11] 4,248,123

[45] Feb. 3, 1981

[54] ELECTRONIC PIANO

[75] Inventors: David A. Bunger; Dale M. Uetrecht, both of Cincinnati, Ohio

[73] Assignee: Baldwin Piano & Organ Company, Cincinnati, Ohio

[21] Appl. No.: 33,096

[22] Filed: Apr. 25, 1979

[51] Int. Cl.[3] ..... G10H 1/12; G10H 5/00

[52] U.S. Cl. ..... 84/1.26; 84/1.1; 84/1.13; 84/DIG. 9; 84/1.19

[58] Field of Search ..... 84/1.01, 1.1–1.13, 84/1.19, 1.21, 1.24, 1.26, 1.27, DIG. 2, DIG. 8, DIG. 9

[56] References Cited

U.S. PATENT DOCUMENTS

| | | | |
|---|---|---|---|
| 2,126,464 | 8/1938 | Hammond | 84/1.21 |
| 2,482,548 | 9/1949 | Kerkof | 84/1.26 |
| 3,444,306 | 5/1969 | Peterson | 84/1.13 |
| 3,507,970 | 4/1970 | Jones | 84/1.01 |
| 3,516,321 | 6/1970 | Harris | 84/1.13 |
| 3,602,628 | 8/1971 | Peterson | 84/1.26 |
| 3,717,715 | 2/1973 | Jordy | 84/1.27 X |
| 3,767,834 | 10/1973 | Hebeisen et al. | 84/1.19 |
| 3,784,718 | 1/1974 | Uchiyama | 84/1.13 |
| 3,836,693 | 9/1974 | Ichikawa | 84/1.19 |
| 3,935,783 | 2/1976 | Machanian et al. | 84/1.21 |
| 3,937,115 | 2/1976 | Staley | 84/1.12 X |
| 3,948,139 | 4/1976 | Melcher et al. | 84/1.19 |
| 4,111,092 | 9/1978 | Adachi | 84/1.27 |
| 4,129,056 | 12/1978 | Jensen et al. | 84/1.26 |
| 4,141,269 | 2/1979 | Itakura | 84/1.27 X |
| 4,142,437 | 3/1979 | Kakehasi | 84/1.24 |

*Primary Examiner*—S. J. Witkowski

[57] ABSTRACT

An electronic musical instrument using continuous tone generators capable of simulating the sounds of a conventional acoustical piano. The instrument includes a gating circuit featuring a timed switch travel circuit having a double-time constant for improved control of the dynamic range from the keyboard, and a soft pedal controlling the keying voltage to produce more realistic emulation of the dynamic effects of an acoustical piano. The gating circuit produces a double-time-constant envelope of nearly harmonically related signals for a more realistic piano timbre. The tone spectrum is also controlled as a function of signal level by means of a resistor matrix feeding selected inputs of an active ladder filter, in order to reproduce timbre variation with dynamic level.

12 Claims, 9 Drawing Figures

ELECTRONIC PIANO

BRIEF SUMMARY OF THE INVENTION

The present invention relates generally to electronic musical instruments, and more particularly to an all-electronic piano including circuitry for producing improved touch responsiveness, voicing, attack and decay characteristics, as well as circuitry for basic tone generation.

Considerable effort has been put forth in the electronic keyboard musical instrument field to produce an all-electronic instrument accurately emulating the sounds of a conventional acoustical piano. One important area of concern has involved electronic circuits to synthesize the touch-responsive waveshape envelopes needed to accurately emulate the tonal attack and decay characteristics of the piano.

In general, touch responsiveness has been obtained in one of three ways. In a first approach a portion of the keystrike is timed to obtain a control voltage potential related to key velocity. Typically, a charged capacitor discharges at a controlled rate during the keystroke interval selected for measurement. The terminal capacitor potential is delivered either to a keyed tone signal oscillator or to a variable gain circuit controlling the envelope of a continuous tone generator. Such an approach has been described, for example, in U.S. Pat. No. 2,126,464 issued Aug. 9, 1938, to Laurens Hammond; U.S. Pat. No. 2,482,548 issued Sept. 30, 1949, to Frederik Kerkhof; and U.S. Pat. No. 3,516,321 issued June 23, 1970, to Michael R. Harris. The Harris reference further suggests the use of a double-time constant discharge of the timing capacitor which permits the transfer of a gating voltage to be controlled over a wide dynamic range.

A second approach to touch responsiveness involves generating a control voltage pulse from the motion of the playing key or an associated action part such as a piano hammer. Typically, a coil or magnet is caused to move by the motion of the playing key or associated part generating an electromotive force which is thereafter rectified and stored as a control potential.

A third approach suggested involves circuitry responsive to the force of impact at the end of the key stroke. In this arrangement, for example, a piezo-electric transducer receives the terminal blow of the key or associated action part and converts this force into a control voltage pulse which is rectified and stored as a control potential for a variable gain circuit.

Some effort has also been expended by prior art workers in the electronic musical instrument field toward finding a simple and effective way to emulate the soft pedal characteristics of a conventional acoustical piano. Generally, the approach taken involves using a volume control to vary the ultimate sound output from the instrument. However, such an approach has not proven entirely acceptable from the standpoint of producing realistic piano sound characteristics.

Tone color and invoicing are also important features of electronic pianos which have heretofore been inadequately controlled. For example, it is well known that the brilliance of a particular tone produced by a conventional acoustical piano is dependent on the force with which the key is struck. In addition, insufficient attention has previously been directed to the timbre associated with individual notes or with small ranges of notes to produce tones which authentically emulate a conventional acoustical piano. The electronic piano of the present invention provides a technique for emulating the tonal attack and decay characteristics of a conventional acoustical piano, as well as the tone quality, using only electronic means except for the playing keys. In accordance with the invention, a capacitor timing circuit is provided for timing the key switch travel in order to obtain a control potential related to key velocity. The output signal from this circuit decays at a double-time constant rate for realistic control over the gating voltages and signal dynamics in a manner similar to the Harris improvement in the firs approach to touch responsiveness described hereinabove.

The attack-decay envelope of the present invention is determined by a sustain capacitor which discharges through a non-linear resistor circuit containing a transistor and collector-base, emitter-base resistors. The output from this timing and envelope control circuitry is applied to a plurality of gates which switch tones from a continuous tone generator comprising an oscillator and frequency dividing circuits. Tone spectra similar to those of a conventional acoustical piano can be produced by utilizing for each note a set of gates corresponding to generator outputs which are not quite harmonically related.

Soft pedal control is achieved in the present invention by a circuit which changes the voltage applied to the capacitor timing circuits in the timing and envelope control, thus lowering this voltage for soft operation below the value for normal operation. This control could, of course, be continuously variable instead of changing in discrete steps as will be described hereinafter. The advantage of this soft pedal over previous electronic soft pedals is that once the key is played, the soft pedal no longer has any effect on the level of the sustained tone just as in a conventional piano.

The damping circuitry is provided in association with the timing and envelope control circuitry to allow the note struck to decay naturally if it is held, or to be damped if the noted is released. The dampers can be overridden by the depression of a sustain pedal, as in a conventional acoustical piano. The depression of the sustain pedal will allow any note struck to decay naturally as long as the pedal is kept depressed. Releasing the pedal damps any notes that are still decaying and returns the system to its normal damping mode.

The voicing scheme of the present invention provides a unique method of feeding the outputs of the tone gates into differently voiced header amplifiers, epending upon the force with which the key is struck. The high amplitudes of the tone signals are processed by both brightly voiced and mellow voiced header amplifiers. Lower level signals are processed only by a mellow voiced header amplifier. Thus the harder the key is struck, the higher the signal level, resulting in a brightly sounding note. As the tone decays to a lower level, the low level header amplifier takes over and causes the note to sound more mellow. This effect enables loud playing to produce brighter tones than soft playing, thus realistically emulating an acoustical piano. In addition, the double-time constant decay used with the tone color change results in an initially bright tone trailing off to a mellow tone, thereby providing wider dynamic control from the keyboard.

The aforementioned voicing scheme uses differently voiced header amplifiers in combination with an active ladder filter. By summing the header amplifier outputs through selected resistors forming a resistor matrix into selected stages of the active filter, a wide variety of tone colorations may be chosen for individual notes or small groups of notes permitting voicing to authentically emulate a piano.

BRIEF DESCRIPTION OF THE DRAWING

FIG. 9 is a timing diagram for the derivation of ⅛ duty cycle pulses.

DETAILED DESCRIPTION

Figure 1:
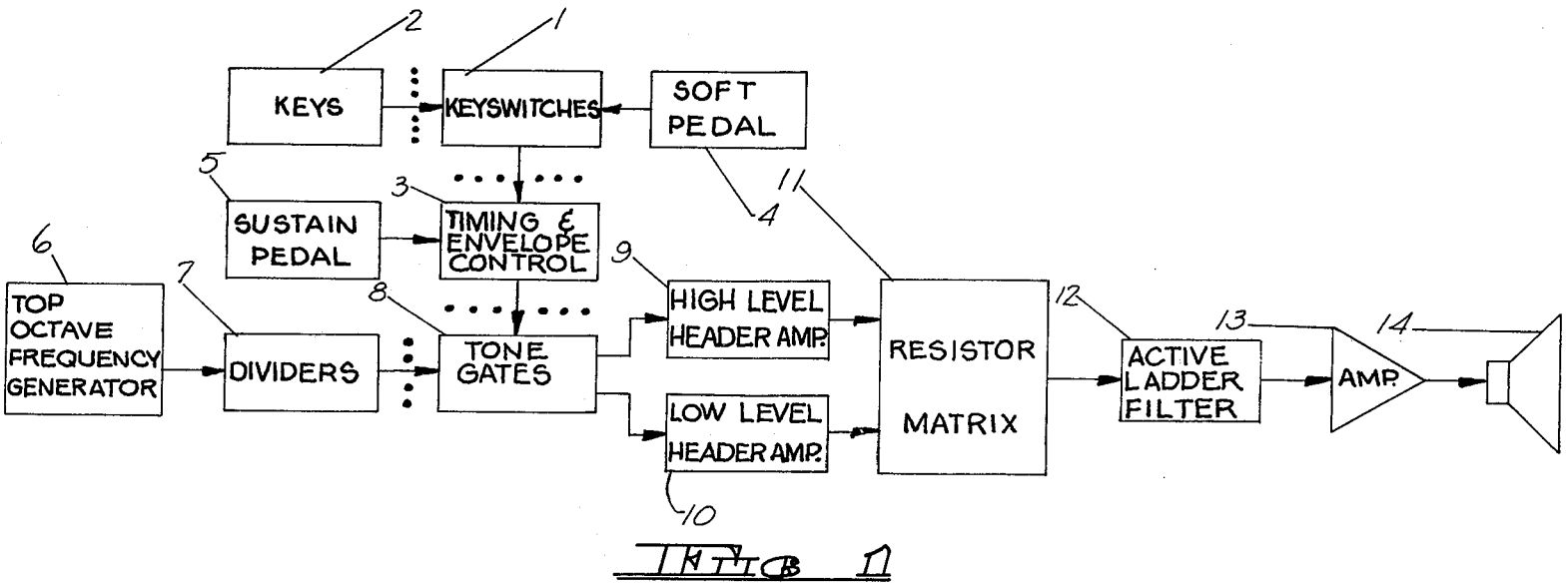
FIG. 1 is a block diagram of the electronic piano of the present invention.

The operational block diagram for the electronic piano of the present invention is illustrated in FIG. 1. A key switch 1 associated with each of the keyboard keys 2 provides a contact closure when the particular key is depressed. Each key switch 1 is associated with a timing and envelope control circuit 3 which produces an attack-decay envelope having a double-time constant decay. A soft pedal switch 4 lowers the voltage supplied to the timing and envelope control circuits 3 through key switches 1 to vary the dynamic characteristics of the attack-decay envelope. In addition, a sustain pedal switch 5 permits any note to decay naturally as long as the pedal switch is kept depressed. Releasing the sustain pedal damps any notes that are still decaying and returns the timing and envelope control circuits 3 to their normal damping mode.

A top-octave frequency generator 6 produces the highest octave of tone signals, which are thereafter reduced in frequency by dividers 7 to give the appropriate lower octaves of notes as is well understood in the art.

The attack-decay envelope signals produced by timing and envelope control circuits 3 are applied to a set of tone gates 8 which combine, in response to the attack-decay envelope signal of timing and envelope control circuits 3, selected related output signals from dividers 7, to produce tones with the desired spectrum of partials including the beating of slightly inharmonic components. The outputs from tone gates 8 are supplied to both high-level header amplifier 9 and low-level header amplifier 10. High-level header amplifier 9 amplifies only the high amplitudes of the tone signals from tone gate 8, while low-level header amplifier 10 amplifies all signal amplitudes supplied by tone gates 8. The output of high-level header amplifier 9 is subsequently voiced more brilliantly than that of low-level header amplifier 10, so that the timbre is brighter for loud playing and the brightness diminishes with respect to time as the amplitude of the tone dies away, giving a very realistic piano tone result.

Voicing of the outputs of header amplifiers 9 and 10 is accomplished by resistor matrix 11 which routes the output signals of the header amplifiers into selected inputs of an active ladder filter 12. This filter provides band-pass ranges for groups of selected notes which transmit the fundamental and other desired partials, but reject unwanted partials, low-frequency intermodulation distortion, and wideband noise.

The output of active ladder filter 12 may be amplified as required by amplifier 13 and delivered to a loudspeaker 14.

Figure 2:
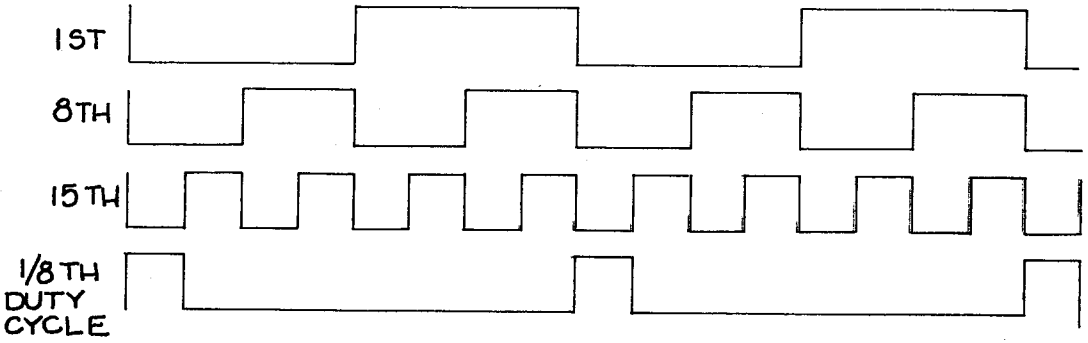
FIG. 2 is a schematic diagram of a first embodiment of the timing and envelope control and tone gate circuits.
Figure 2:
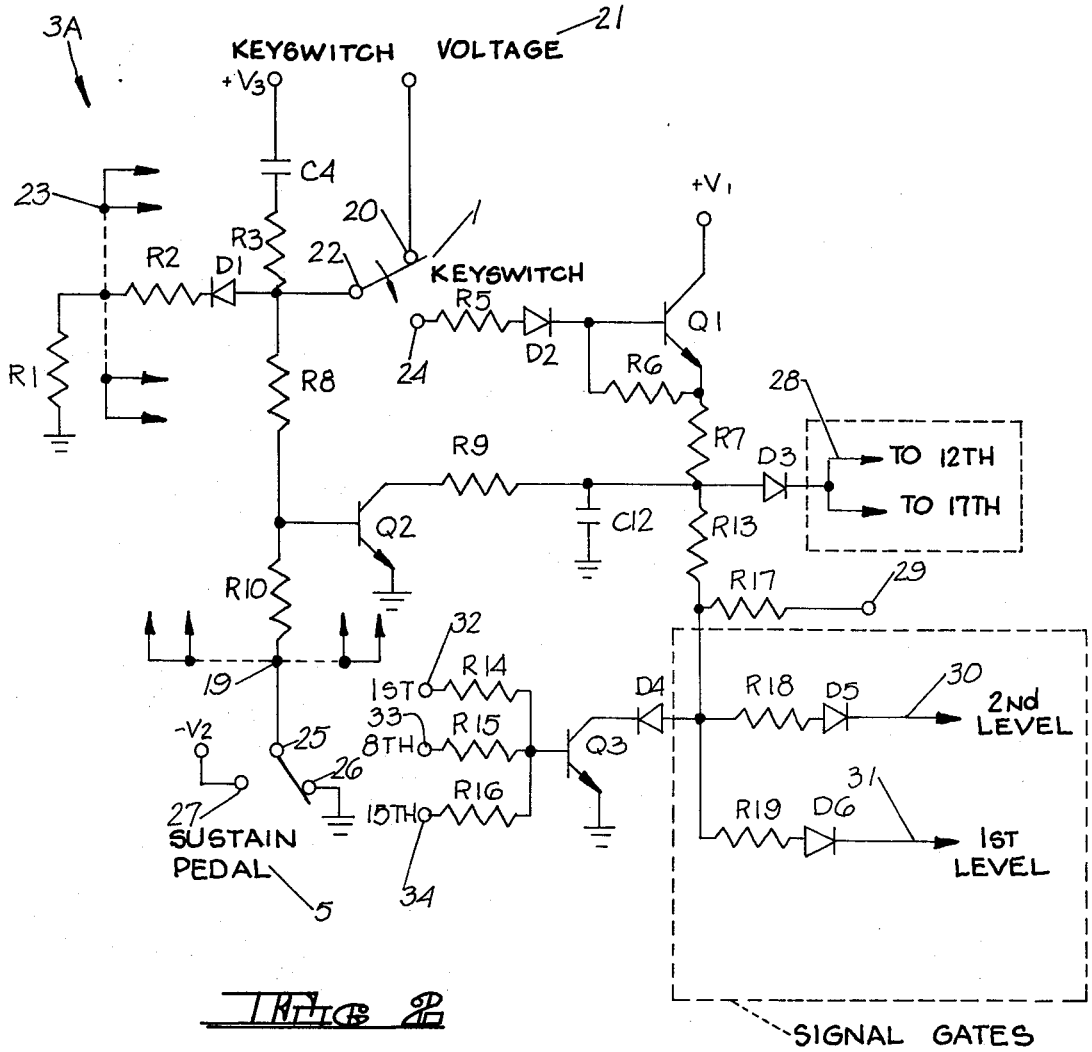
Figure 3:
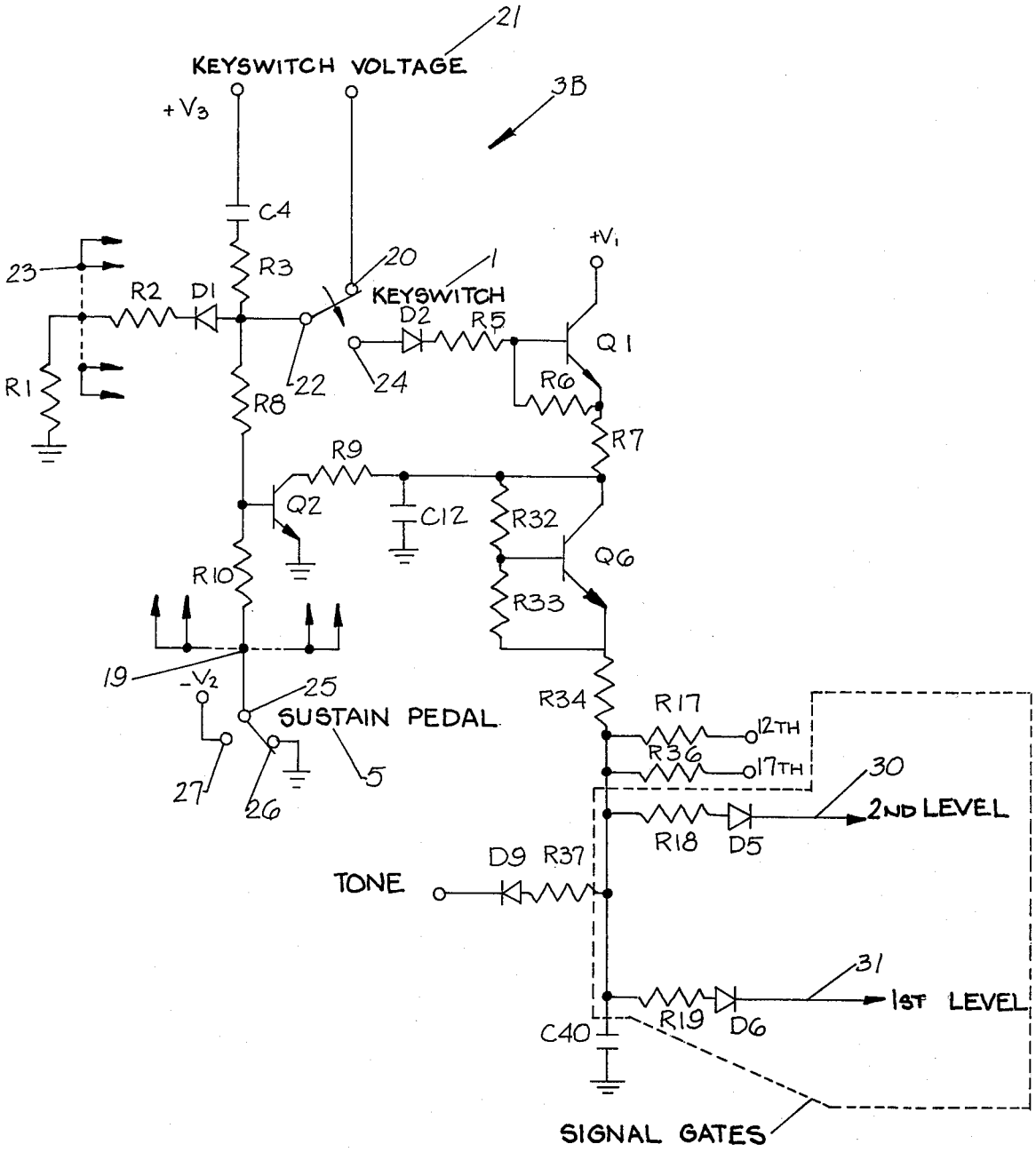
FIG. 3 is a schematic diagram of a second embodiment of the timing and envelope control and tone gate circuits.
Figure 4A:
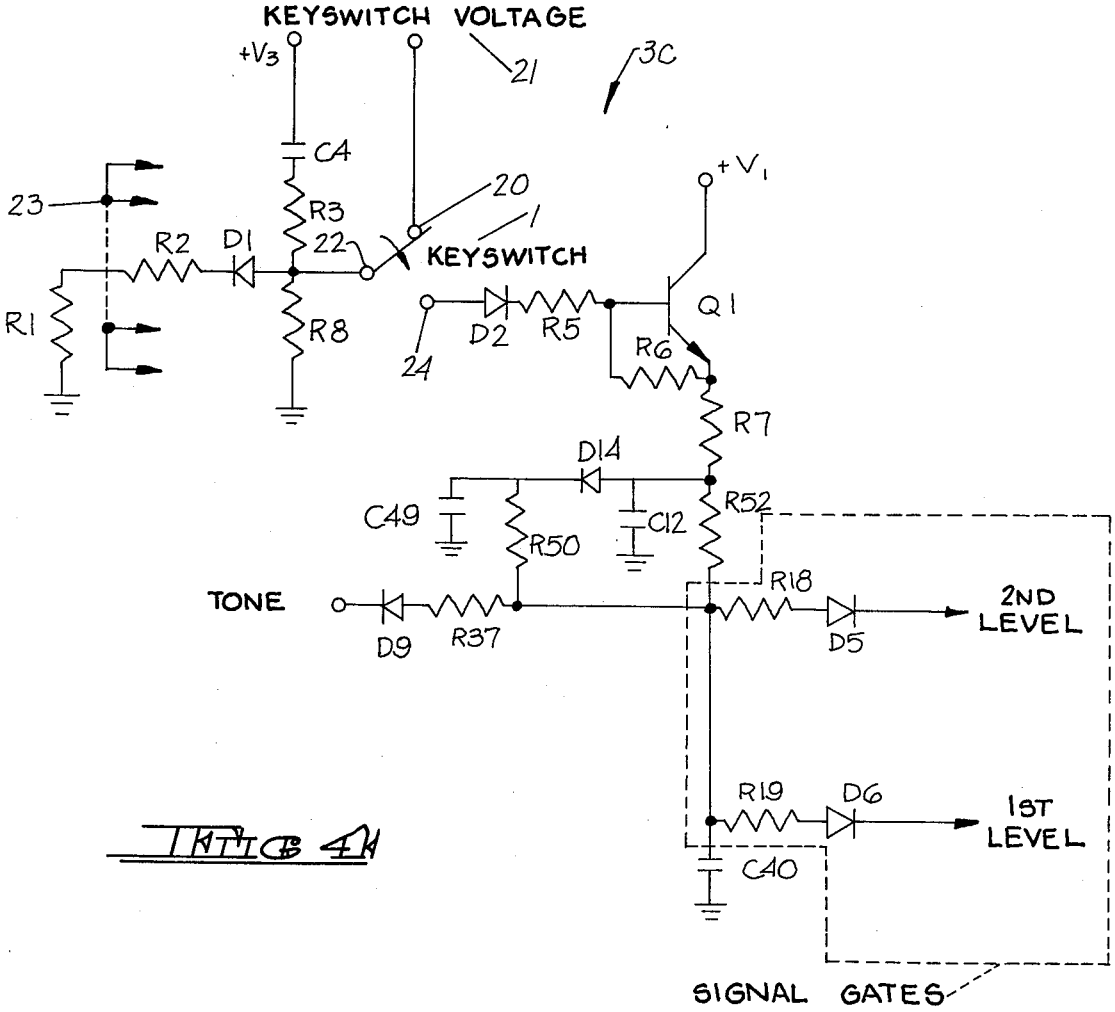
FIG. 4 is a schematic diagram of a third embodiment of the timing and envelope control and tone gate circuits.

The timing and envelope control circuits 3 are of three variations shown in detail in FIGS. 2, 3, and 4. Each of the keys associated with the lower notes of a conventional piano keyboard may utilize one of the timing and envelope control circuits 3A shown in FIG. 2. Similarly, each of the keys associated with the middle range of notes of a conventional piano keyboard may utilize one of the timing and envelope control circuits 3B illustrated in FIG. 3. Finally, each of the keys associated with the upper notes of a conventional piano keyboard may use one of the timing and envelope control circuits 3C illustrated in FIG. 4. As will become apparent, the operation of each of these circuits 3A–3C is similar, differences occurring primarily in the voicing desired for particular ranges of notes.

Each of the lower range timing and envelope control circuits 3A shown in FIG. 2 has associated therewith a key switch 1 which is activated in response to the depression of one of the piano keys 2. The normally closed contact 20 of switch 1 is connected to key switch voltage 21, while the stationary contact 22 of key switch 1 is connected to the junction of resistor R3, resistor R8, and the anode of diode D1. A resistor R2 is connected between the cathode of diode D1 and summing point 23. Summing point 23 is connected to ground through resistor R1. The remaining end of resistor R3 is connected to voltage $+V_3$ through capacitor C4.

Normally open contact 24 of key switch 1 is connected to the base of transistor Q1 through the series combination of resistor R5 and the anode to cathode of diode D2. The collector of transistor Q1 is connected to supply voltage $+V_1$. A resistor R6 is connected between the base and emitter of transistor Q1. The emitter of transistor Q1 is further connected through resistor R7 to a capacitor C12, a resistor R9, a resistor R13 and the anode of diode D3. The remaining end of capacitor C12 is connected to ground, while the remaining end of resistor R9 is connected to the collector of transistor Q2. The emitter of transistor Q2 is connected to ground, while the base is connected between the remaining end of resistor R8 and one end of resistor R10. Resistor R10 is connected to summing point 19 and a fixed contact 25 of sustain switch pedal 5. The normally closed contact 26 of sustain switch pedal 5 is connected to ground, while the normally open contact 27 is connected to supply voltage $-V_2$.

The cathode of diode D3 is connected to a summing point 28. The remaining end of resistor R13 is connected to summing point 29 through resistor R17, to second level output line 30 through the series combination of resistor R18 and the anode to cathode of diode D5, to first level output line 31 through the series combination of resistor R19 and the anode to cathode of diode D6, and to the anode of diode D4. The cathode of diode D4 is connected to the collector of transistor Q3. The emitter of transistor Q3 is connected to ground, while the base is connected through resistors R14, R15, and R16, to summing points 32, 33 and 34, respectively.

As shown in FIG. 2, key switch 1 is in the normally closed position so that capacitor C4 is initially charged to the key switch voltage 21. Resistor R3 acts as a current limiting resistance to prevent arcing on the switch contact. When the key associated with key switch 1 is played, the key switch contact will begin moving toward normally open contact 24, and capacitor C4 will begin discharging at a fixed rate, with the initial RC time constant being determined primarily by resistor R2 and capacitor C4. Each of the other circuits 3A associated with the lower notes of the piano keyboard will also be connected to summing point 23 and will function in a similar manner.

When the decay voltage on capacitor C4 reaches a certain level, as determined by the relative magnitudes of resistors R1 and R2, diode D1 becomes reverse biased, and a second slower discharge path exists through resistors R8 and R10 to ground through normally closed sustain pedal switch 5. In general, resistor R8 will be chosen so as to be much larger than resistor R10, so that resistor R8 may be considered effectively tied to ground when determining the second RC time constant. Corresponding points from the remaining circuits 3A will be connected to summing point 19.

When the transition of key switch 1 reaches normally open contact 24, the voltage remaining on capacitor C4 is transferred to the base of transistor Q1 through resistor R5 and diode D2. It will be understood that if the key associated with key switch 1 has been struck with a large force, thereby producing a short key-switch transition time, the voltage transferred to normally open contact 24 would be relatively large and determined by the initial decay rate associated with resistor R2 and capacitor C4. However, a key struck softly, which produces a relatively long key-switch transition time, causes the voltage transferred to normally open terminal 24 to be relatively small and determined by the second decay rate produced by capacitor C4 and resistor R8. This permits soft playing without the need for critical timing, which would be required if only the initial, and much more rapid decay rate were utilized.

Since transistor Q1 is normally biased in the off state, the voltage transferred from capacitor C4 through normally open contact 24 tends to turn transistor Q1 on. The base-emitter current so produced is supplemented by the collector-emitter current and passes through resistor R7 to the sustain capacitor C12. Sustain capacitor C12 charges very quickly to the level of the decay voltage existing on normally open contact 24, at which time transistor Q1 turns off. Resistor R5 limits the discharge current of C4 into the transistor Q1 to optimize charge transfer to C12, while resistor R6 prevents collector-base leakage current from turning transistor Q1 on. Diode D2 prevents current flow in the reverse direction through key switch 1.

With key switch 1 in the actuated or normally open position, and sustain capacitor C12 charged, transistor Q2 is turned off. However, when the key associated with key switch 1 is released, causing the key-switch voltage 21 to appear on stationary contact 22, transistor Q2 is turned on, providing a low impedance discharge path for sustain capacitor C12 through resistor R9. This rapid discharge provides for damping necessary to accurately emulate a damped piano tone, and can be adjusted by varying the magnitude of resistor R9. Damping can be defeated by actuating sustain pedal switch 5 which places a negative voltage $-V_2$ on summing point 19, thereby causing transistor Q2 to remain off, such that sustain capacitor C12 discharges slowly. It will be observed that with sustain pedal switch 5 actuated, even the release of the key associated with key switch 1 does not operate to damp the discharge of capacitor C12, thereby providing a realistic piano sustain effect.

The remaining portions of the circuits shown in FIG. 2 comprise various tone gates 8 which combine selected ones of the nearly harmonically related output signals from dividers 7 to produce a particular tone of the desired spectrum. In the circuit of FIG. 2 associated with the lower piano tones, the fundamental, second harmonic and fourth harmonic square wave frequencies of a particular tone, associated with the first, eighth and fifteenth notes of the scale are applied to summing points 32–34, respectively, and combined in the NOR gate formed by resistors R14–R16, transistor Q3 and diode D4, to produce the $\frac{1}{8}$ duty cycle pulses shown in FIG. 9. These $\frac{1}{8}$ duty cycle pulses provide the input for the proper voicing of the lower tones of the piano tone emulation.

The decaying voltage appearing on sustain capacitor C12 delivers bias current to the collector of transistor Q3, diode $D_4$, diode $D_5$, and diode $D_6$ via resistors $R_{13}$, $R_{18}$ and $R_{19}$. The $\frac{1}{8}$ duty cycle pulses are gated to the collector of Q3 and the anode of diode D4, and are further gated to the high and low level header amplifiers by means of the signal gates formed by the series combination of resistor R18 and diode D5, and resistor R19 and diode D6, respectively. As will be described in more detail hereinafter, the output appearing at output line 30 labeled 2nd LEVEL will be connected to the input of the high level header amplifier 9, while the output associated with output line 31 designated 1st LEVEL will be connected to the input of low level header amplifier 10. It will also be observed that resistor R13 may be selected for each circuit 3A to provide the desired time constant when sustain capacitor C12 is discharging in the undamped mode. Resistors R18 and R19 are selected to be of the same order of magnitude as resistor R13 to assure proper division of output signal between output lines 30 and 31.

The decaying voltage stored on sustain capacitor C12 is also gated through diode D3 to summing resistors associated with nearly harmonically related gates connected to summing point 28. For example, for a particular note, diode D3 associated with circuit 3A corresponding to note $A_0$ may be connected to summing point 29 and resistor R17 of a circuit 3A corresponding approximately to the third harmonic of $A_0$ (the twelfth note of the A scale), or note $E_2$. Likewise, summing point 28 of circuit 3A associated with note $A_0$ may be connected through a similar summing resistor to a circuit to be described hereinafter associated with the approximate fifth harmonic component of $A_0$ or the seventeenth note $C_3^{\#}$ of the A scale. By scaling the summing resistors R17 associated with the approximate third and fifth harmonic circuits, the amounts of nearly harmonically related tones can be adjusted to give the desired amount of these partials and to produce an audible amount of beating between slightly inharmonic components, thus contributing to the overall piano tone emulation. The purpose of diode D3 is to prevent the gate associated with the note $A_0$ from turning on when either of the notes associated with $E_2$ or $C_3^{\#}$ is played.

Timing and envelope control circuit 3B illustrated in FIG. 3 is generally similar to circuit 3A of FIG. 2, and is designed primarily for use with the notes associated with the middle range of a conventional piano keyboard. Components appearing in the circuit of FIG. 3 which serve the same function as those appearing in the circuit of FIG. 2 have been given the same designation.

Turning to FIG. 3, double rate decay of tone is accomplished with resistors R32, R33 and R34 in conjunction with transistor Q6. Initially, the voltage transferred through key switch 1 to sustain capacitor C12 turns transistor Q6 on, so that current flows from the collector of this transistor to the emitter and by means of resistor R34 to capacitor C40. As the voltage decays, Q6 will turn off at a voltage level determined by resistors R32 and R33. When this occurs, capacitor C12 discharges through resistors R32, R33 and R34. By insuring that the total resistance of R32 and R33 is much larger than that of resistor R34, the initial decay will be relatively large until Q6 turns off, whereupon the decay rate will diminish giving a longer sustained time to the tone.

As described hereinabove, the signals appearing at summing point 28 in circuit 3A of FIG. 2 are applied to the mid-range timing and envelope control circuits 3B through summing resistors R17 and R36.

In circuit 3B, the NOR gate of FIG. 2 which produces the $\frac{1}{8}$ duty cycle pulses has been replaced by an integrating circuit formed by the series combination of diode D9 and resistor R37 connected to the junction of resistor R34 and capcitor C40. This circuit converts the square wave output from dividers 7, indicated as the TONE signal in FIG. 3, to a sawtooth signal containing the harmonics needed for emulating piano tones. This sawtooth signal is then gated to the high and low level header amplifiers in a manner similar to that described hereinbefore for the $\frac{1}{8}$ duty cycle pulses of FIG. 2. Again, resistors R17 and R36 will be selected to establish the desired blending of inharmonic partials to produce the piano emulation.

The timing and envelope control circuit 3C of FIG. 4 is similar to that described hereinbefore in connection with the circuits of FIG. 2 and FIG. 3, and is particularly adapted for use with the upper notes of the piano keyboard. The components in FIG. 4 which serve the same function as similar components in FIG. 2 and FIG. 3 have been given the same designation.

In the circuits 3C of FIG. 4, double rate decay is accomplished using two sustain capacitors C12 and C49, and two time-constant determining resistors R50 and R52. A diode D14 prevents interaction between the capacitors. Initially, when key switch 1 is closed, the charge on capacitor C4 is transferred to capacitor C12 and capacitor C49, with the voltage on capacitor C49 being one diode voltage drop lower than that on capacitor C12. As the note sustains, capacitor C12 discharges through resistor R52, while at the same time capacitor C49 discharges through resistor R50. Since resistor R52 is much smaller than resistor R50, two RC time constants are produced which control the envelope of the tone signal. That is, capacitor C12 and resistor R52 determine the fast initial decay, while capacitor C49 and resistor R50 determine the long sustained decay. The signal gates and sawtooth shaping circuit operate similarly to circuit 3B of FIG. 3. In addition, it will be observed that circuits 3C do not utilize a sustain pedal switch 5 and associated circuitry because the strings in the upper part of a piano scale are typically not equipped with dampers.

Figure 7:
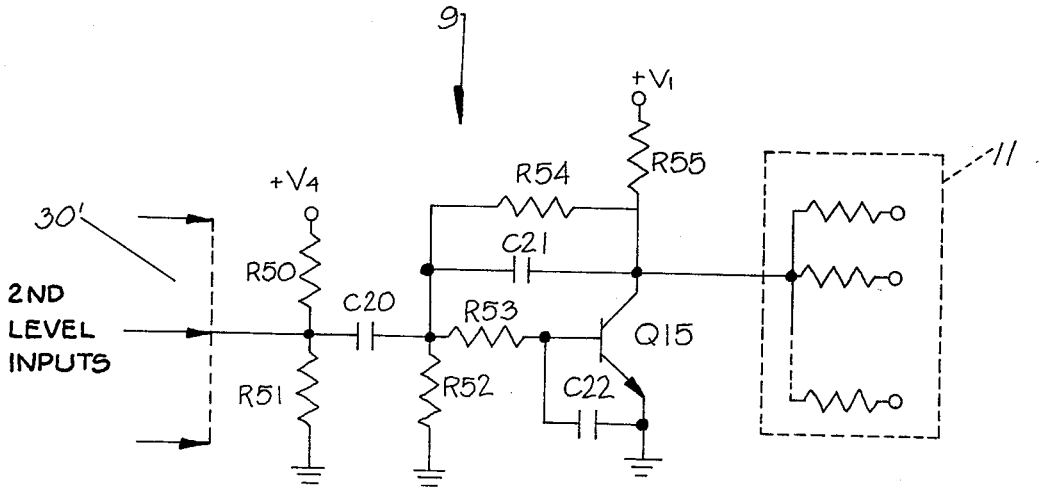
FIG. 7 is a schematic diagram of the high level header amplifier.

The 2nd LEVEL outputs from timing and envelope control and tone gate circuits 3A–3C are applied to the summing point 30′ at the input of high level header amplifier 9 shown in FIG. 7 formed by the junction of resistor R50, resistor R51 and coupling capacitor C20. One end of resistor R50 is connected to supply voltage $+V_4$, while one end of resistor R51 is connected to ground. These components form a bias voltage at the amplifier input which insures that only the high amplitudes of the tone signals are amplified by header amplifier 9. For example, when a particular note is forcibly struck, the positive peaks of the signal produced by the associated timing and envelope control circuits 3 and tone gates 8 are of sufficient amplitude to be amplified by high level header amplifier 9. However, as the tone decays, the signal amplitude falls below the bias voltage established by resistors R51 and R52 so that no signals are passed by high level header amplifier 9.

Signals presented to high level header amplifier 9 are coupled through coupling capacitor C20 to the junction of resistors R52, R53, R54 and capacitor C21. The remaining end of R52 is connected to ground, while the remaining terminal of R53 is connected to the base of amplifier transistor Q15 and a capacitor C22. The collector of transistor Q15 forms the output of header amplifier 9 and is connected to the remaining terminals of R54 and C21, as well as one end of resistor R55. The remaining end of resistor R55 is connected to supply voltage $+V_1$. The emitter of transistor Q15 and the remaining terminal of capacitor C22 are connected to ground. It will be observed that resistors R52, R54 and R55 provide bias voltage for transistors Q15. In addition, resistor R53 and capacitors C21 and C22 provide RF interference rejection. Resistor R54 also serves as a feedback resistor to set the gain of the amplifier.

Figure 8:
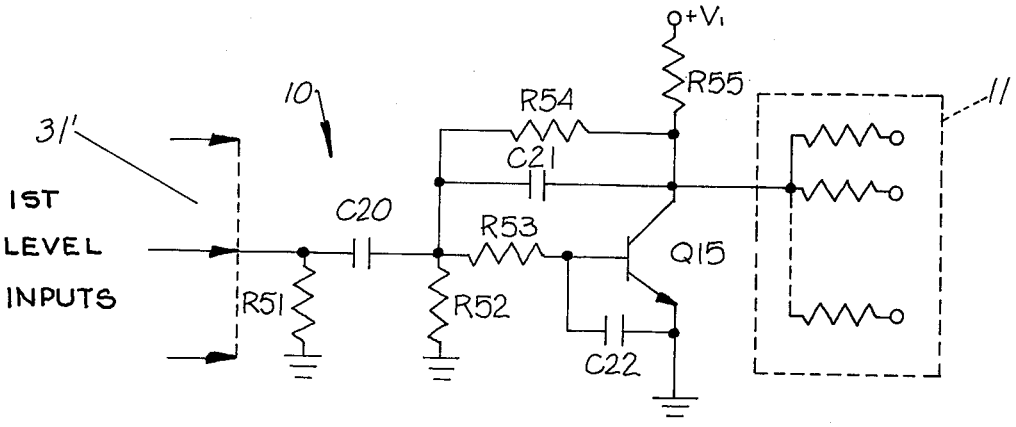
FIG. 8 is a schematic diagram of the low level header amplifier.

The low level header amplifier 10 shown in FIG. 8 is configured similarly to the high level header amplifier 9, with the exception that resistor R50 is not utilized so that there is no bias voltage at the input to the low level header amplifier. Thus low level header amplifier 10 amplifies all signal levels supplied by tone gates 8 and presented to summing point 31′ at its input.

The outputs of the high and low level header amplifiers are voiced differently through the use of resistor matrix 11 which sums the output signals into selected inputs of active ladder filter 12, such as that described in co-pending patent application Ser. No. 33,097 filed Apr. 25, 1979 by Dale M. Uetrecht and assigned to Baldwin Piano and Organ Company. Adjustment of the resistors comprising the resistor matrix, as well as the selected inputs to the active ladder filter, permit realistic voicing. In general, high level header amplifier 9 output will be voiced more brilliantly than the low level header amplifier 10 output in order to insure that the initial portion of the piano tone will sound bright, while the sustaining portion of the tone will sound more mellow under control of low level header amplifier 10.

Figure 5:
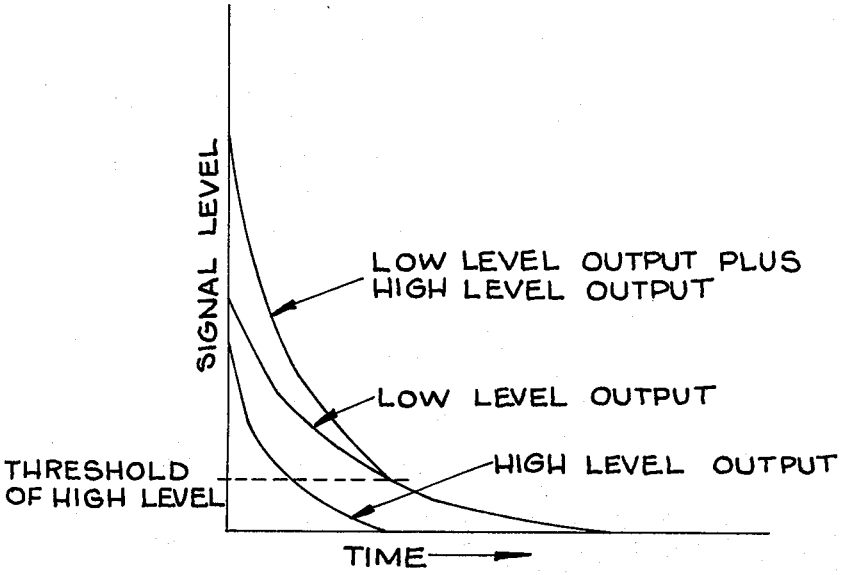
FIG. 5 is a timing diagram illustrating the double rate decay characteristics of the timing and envelope control circuit.

The effect of this two level voicing technique can be observed in FIG. 5 where the relative high and low level header amplifier outputs are plotted as a function of time. Initially, both header amplifiers will be amplifying the rapidly decaying high level signal produced by the timing and envelope control circuit 3 and tone gate 8, which will be combined through resistor matrix 11 and active ladder filter 12 to the composite signal illustrated in FIG. 5 as the low level output plus high level output. After a period of time, the output signals from the timing and envelope control and tone gate circuits will decay below the high level header amplifier threshold, whereupon only the low level header amplifier 10 will be producing an output for more mellow voicing by resistor matrix 11 and active ladder filter 12. Thus the output double rate decay is enhanced and piano tones are more realistically synthesized. In fact, this part of the output double decay turns out to be sufficient for lower range notes as in FIG. 2.

Figure 6:
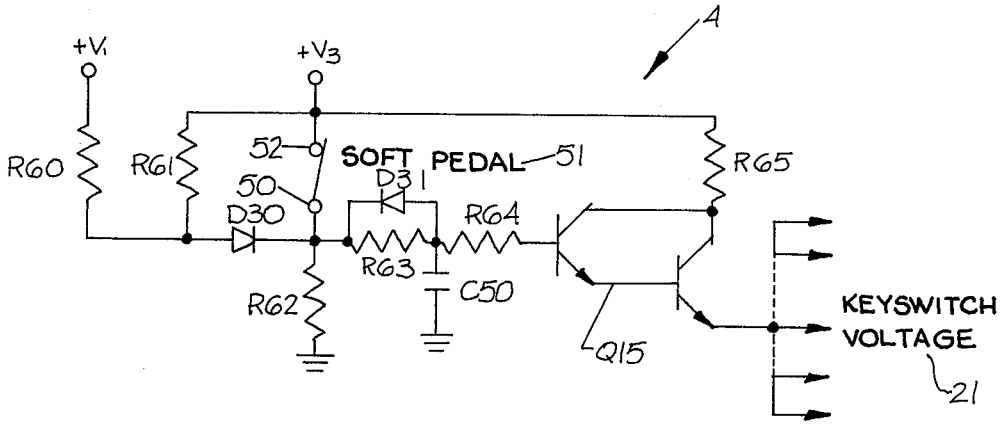
FIG. 6 is a schematic diagram of the soft pedal dynamic control circuit.

FIG. 6 illustrates the soft pedal dynamic control circuit 4, which has the effect of lowering key switch voltage 21 for soft operation. As shown in FIG. 6, a resistor R60 is connected between supply voltage $+V_1$ and the junction of resistor R61 and the anode of diode D30. The cathode of diode D30 is connected to the stationary contact 50 of soft pedal 51, resistor R62, resistor R63, and the cathode of diode D31. The remaining terminal of resistor R62 is connected to ground, while the remaining terminals of R63 and D31 are connected to resistor R64 and capacitor C50. The remaining terminal of C50 is connected to ground, while the free end of resistor R64 is connected to the base of Darlington transistor Q15. The collector of transistor Q15 is connected to a resistor R65, and the emitter supplies key switch voltage 21 to timing and envelope control circuits 3A–3C as described hereinbefore. The remaining terminals of resistors R61 and R65, as well as the normally closed contact 52 of soft pedal 51, are connected to supply voltage $+V_3$.

In operation, with soft pedal switch 51 in the normally closed or unactivated position, current flows through components R63, R64 and Q15 to provide circuits 3A–3C with the normal key switch voltage 21. However, when the soft pedal switch 51 is opened for soft playing, capacitor C50, which heretofore has been charged to supply voltage $+V_3$, begins to discharge quickly through diode D31 and resistor R62. When the voltage on capacitor C50 drops below the voltage at the anode of diode D30, diode D30 begins to conduct to produce a lower key switch voltage 21. Since key switch voltage 21 is lower, timing capacitors C4 associated with circuits 3A–3C are initially charged to a lower voltage, thus also lowering the overall attack-decay envelope characteristics of timing and envelope control circuits 3.

When soft pedal switch 51 is returned to the normally closed position, capacitor C50 is charged relatively slowly through resistor R63. It will be observed that the relative decrease in amplitude produced by soft pedal circuit 4 will depend upon the relative magnitudes of resistors R60 and R61 which form the voltage divider for the lower key switch voltage.

It will be understood that various changes and the details, materials, steps and arrangements of parts, which have been hereindescribed and illustrated in order to explain the nature of the invention, may be made by those skilled in the art within the principle and scope of the invention as expressed in the appended claims.

The embodiments of the invention in which an exclusive property or privilege is claimed are as follows:

1. In an electronic musical instrument of the type having a plurality of keys, a key switch with an unactuated and an actuated position associated with each key for providing a control voltage when said key is actuated, a source of tone signals, and a plurality of tone gate circuits each tone gate circuit associated with an individual key switch for combining one or more of said tone signals under control of said control voltage to produce a pair of output signals, the improved means for emulating piano tones in combination therewith comprising first and second header amplifiers responsive to some at least of said tone gate outputs, said first header amplifier passing a first range of signal amplitudes, said second header amplifier passing only a second range of signal amplitudes greater than a predetermined non-zero threshold, and means connecting outputs from a plurality of tone gate circuits to each of said first and second header amplifiers.

2. The apparatus according to claim 1 wherein said first header amplifier passes only signals greater than a first predetermined threshold, and said second header amplifier passes only signals greater than a second predetermined threshold.

3. The apparatus according to claims 1 or 2 wherein said first header amplifier passes all signal amplitudes supplied by said tone gates.

4. The apparatus according to claim 3 including an electrical filter connected to the output of said second header amplifier, said filter operating to provide more brilliant voicing for signals passed by said second header amplifier than for signals passed by said first header amplifier.

5. The apparatus according to claim 1 including a resistor matrix having inputs and a plurality of outputs and an active ladder filter having a plurality of inputs, each of said matrix inputs being connected to a respective one of said header amplifier outputs, and each of said resistor matrix outputs being connected to one selected input of said active ladder filter, said filter operating to provide more brilliant voicing for signals passed by said second header amplifier than for signals passed by said first header amplifier.

6. The apparatus according to claim 1 wherein said instrument includes a timing and envelope control circuit in association with each of said key switches for providing a control voltage having an initial value proportional to the force with which said key is struck.

7. The apparatus according to claim 6 wherein said control circuit includes means for producing a control voltage which decays from said initial voltage level to a first voltage level at a first rate and thereafter from said first voltage level at a second rate.

8. The apparatus according to claim 7 wherein said second rate has a value less than said first rate.

9. The apparatus according to claim 7 wherein said control voltage producing means comprises a voltage source, capacitor means charged by said voltage source when said key switch is unactuated, first means for discharging said capacitor means at said first rate until said first voltage level is reached, and second means for discharging said capacitor means at said second rate when said control voltage is less than said first level.

10. The apparatus according to claim 9 wherein said key switch includes a normally open contact, a normally closed contact, and a fixed contact, said capacitor means being connected between said voltage source and said fixed contact, said first discharging means comprising the series combination of a first resistor, a second resistor, and a diode connected to said fixed contact, said first voltage level being determined by the relative values of said first and second resistors, said second discharge means comprising a third resistor connected to said fixed contact.

11. The apparatus according to claim 6 including capacitor means connected to said key switch for storing the value of said control voltage present when said key switch assumes said actuated position, said circuit including damping means for discharging said capacitor at a predetermined rate.

12. The apparatus according to claim 11 wherein said damping means further include switch means and sustain means operative to prevent discharge of said capacitor means when said switch means is actuated.

* * * * *